US005992568A

United States Patent [19]

Craig et al.

[11] Patent Number: 5,992,568

[45] Date of Patent: Nov. 30, 1999

[54] RAIL LUBRICATOR MOUNTED TO A TRACK VEHICLE

[75] Inventors: Jeffrey P. Craig, Monroeville; William T. Urmson, Jr., Valencia, both of Pa.; Peter C. Lounsberry, Endwell, N.Y.

[73] Assignee: Portec Rail Products, Inc., Pittsburgh, Pa.

[21] Appl. No.: 09/010,218

[22] Filed: Jan. 21, 1998

[51] Int. Cl.[6] ..... B61K 3/00

[52] U.S. Cl. ..... 184/3.2; 184/3.1; 105/72.2

[58] Field of Search ..... 184/3.1, 3.2, 5, 184/21, 22, 23; 105/72.2, 215.2; 222/309

[56] References Cited

U.S. PATENT DOCUMENTS

| | | | |
|---|---|---|---|
| 1,081,419 | 12/1913 | Youtsey . | |
| 1,701,506 | 2/1929 | Reid . | |
| 1,707,183 | 3/1929 | Agner | 184/3.2 |
| 1,742,370 | 1/1930 | Protzeller . | |
| 1,758,300 | 5/1930 | Dresser . | |
| 2,586,256 | 2/1952 | Quarles | 299/31 |
| 3,195,681 | 7/1965 | Hirata | 184/3 |
| 3,542,153 | 11/1970 | Phillips | 184/3 |
| 4,736,818 | 4/1988 | Wolfe | 184/3.2 |
| 5,236,063 | 8/1993 | Nelson et al. | 184/3.2 |
| 5,477,941 | 12/1995 | Kumar et al. | 184/3.2 |
| 5,586,507 | 12/1996 | Madison et al. | 105/215.2 |
| 5,687,814 | 11/1997 | Craig et al. | 184/3.2 |
| 5,756,903 | 5/1998 | Norby et al. | 73/786 |

*Primary Examiner*—Tamara L. Graysay
*Assistant Examiner*—David Fenstermacher
*Attorney, Agent, or Firm*—Webb Ziesenheim Logsdon Orkin & Hanson, P.C.

[57] ABSTRACT

A device for lubricating a track or a rail that is adapted to be mounted to a wheeled vehicle. The device includes a frame member adapted to be mounted to the vehicle and an arm pivotally attached to the frame member. A roller, which is adapted to ride on the rail, mounts to the arm and receives a guide. A lubricating nozzle attaches to the guide.

19 Claims, 5 Drawing Sheets

RAIL LUBRICATOR MOUNTED TO A TRACK VEHICLE

BACKGROUND OF THE INVENTION

1) Field of the Invention

The present invention relates to a device for lubricating railroad rails which are mountable to a track vehicle.

2) Description of the Prior Art

It has long been the practice to apply grease or similar gel-like lubricants to the sides of rails at curves, switches and other parts of the railroad track. Such lubricants are still applied to the inside sides of the rail head to reduce the friction which occurs as the flanges of the train's wheels contact the sides of the rail. Lubricants and/or friction controlling gels are also applied to the top of the rail. The friction reduction results in reduction of wear of both the rail and the wheels and reduced fuel consumption of the locomotion of the train and of squealing noises.

Devices for lubricating rails are already known, such as U.S. Pat. No. 5,687,814. Typically, these devices for lubricating rails are mounted on a track vehicle, such as a pickup truck equipped with additional flanged wheels. The lubricating nozzle of the device is secured to a rail gear mounted to a truck body.

Preferably, the devices for lubricating rails should direct the lubricant L along a straight line at a constant fixed distance as measured from the head of the rail as shown in FIG. 1A. However, due to the suspension of the track vehicle and the varying weight of the vehicle due to varying loads, the position of the lubricant L varies on the track as shown in FIG. 1B. This varying position of the lubricant can cause excessive waste, inefficient lubricant use and locomotion traction problems if the lubricant is mistakenly placed on the top of the rails.

Therefore, it is an object of the present invention to provide a device for lubricating a rail that can accurately apply lubricant to a rail.

SUMMARY OF THE INVENTION

Our invention is a device for lubricating a rail that includes a frame member adapted to be mounted to a track vehicle, an arm pivotally attached to the frame member, a roller slidably and rotatably attached to the arm and adapted to ride on a rail, and a lubricating nozzle attached to the roller for directing a lubricant toward a rail. The roller is adapted to rotate about and move along a longitudinal axis relative to the arm. The position of the lubricating nozzle and the roller is constant relative to each other. The roller can include a tapered or flanged surface to coact with a rail. The tapered surface is adapted to receive a portion of a rail. A guide is rotatably attached to the roller. The guide includes a first rod slidably extending through the arm and a plate secured to an end of the first rod, wherein the roller is rotatably secured to the plate. A second rod is attached to the arm and rotatably secured to the roller, wherein the second rod is parallel to the first rod. A stop is provided which is coupled to the arm for limiting movement of the roller along the longitudinal axis. The stop can be a pin removably received by holes defined in the first rod.

DESCRIPTION OF THE PREFERRED EMBODIMENTS

Figure 2:
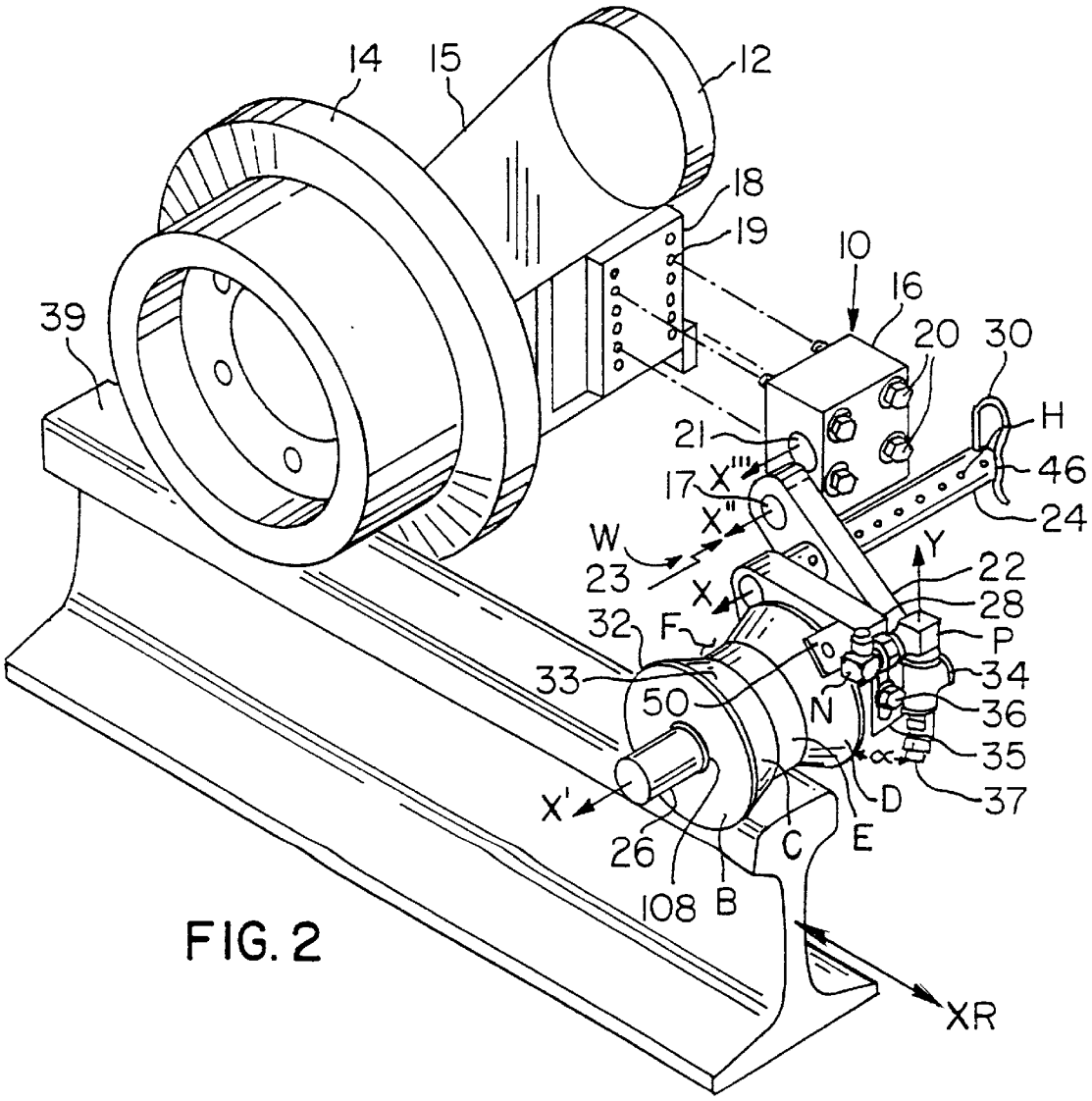
FIG. 2 is a perspective view of a device for lubricating a rail made in accordance with the present invention.
Figure 3:
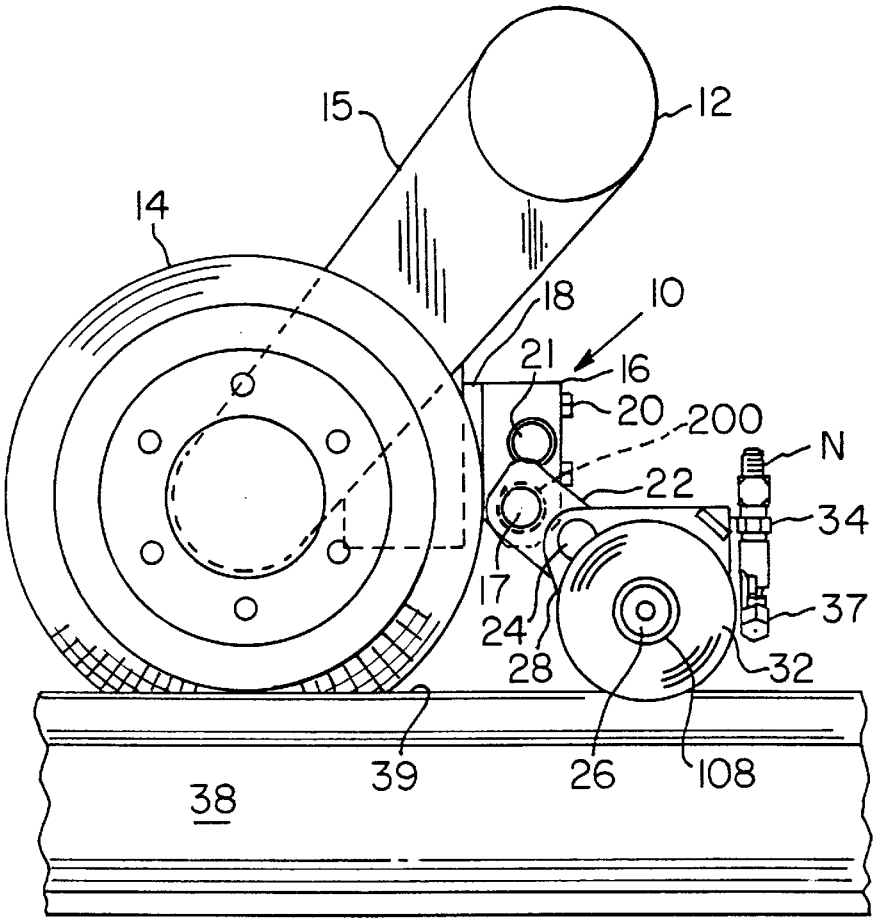
FIG. 3 is a side elevation of the device shown in FIG. 2.
Figure 4:
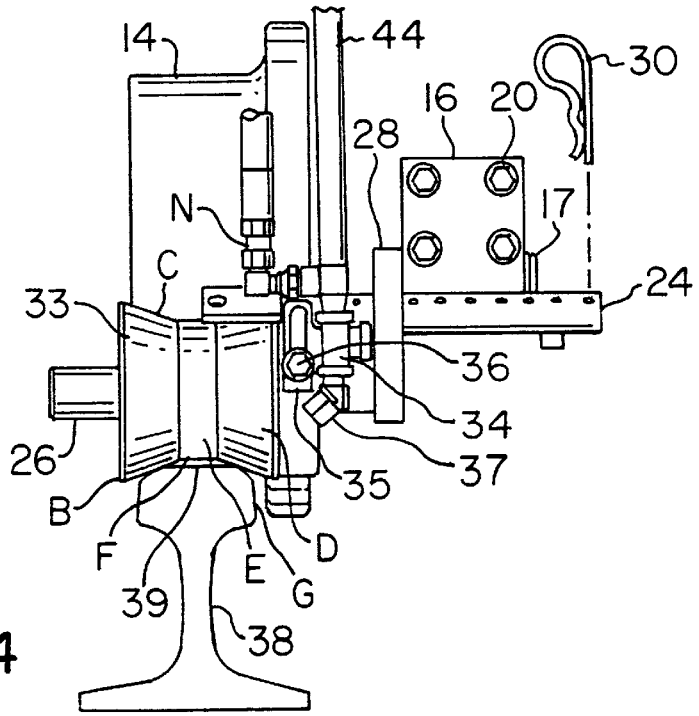
FIG. 4 is a rear elevation of the device shown in FIG. 2 with a portion of a hose attached to a hydraulic adaptor.

FIGS. 2–4 show a device for lubricating a rail or a rail lubricator 10 made in accordance with the present invention in an engaged position. The device for lubricating a rail 10 mounts to a track vehicle, for example, through rail gear 12 that includes two spaced apart flanged guide wheels 14 (one of which is shown) secured to a frame on a pickup truck. Generally, each flanged guide wheel 14 is rotatably mounted to a retractable arm 15 that is mounted to the pickup truck. Rail gears 12 are well known in the art and will not be discussed in further detail.

The device for lubricating a rail 10 includes a frame member 16 that is secured to a flat-metal mounting plate 18 by bolts 20. The mounting plate 18 is secured to the arm 15 by welding the mounting plate 18 to the arm 15. The mounting plate 18 includes a plurality of threaded securement holes 19 that threadably receive the bolts 20. A hole 21 passes through the frame member 16 transverse to the bolt holes defined therein.

An arm 22 pivotally attaches to the frame member 16 through a shaft 17. A guide 23 attaches to the arm 22 and includes a first cylindrical rod 24 and a plate 28. The first cylindrical rod 24 is fixedly secured to the plate 28 and extends slidably through a hole defined in the arm 22 so that the first cylindrical rod 24 can slide along a longitudinal axis X. The first cylindrical rod 24 also includes a plurality of holes H extending along the longitudinal axis X. A snap pin or stop 30 is removably received by one of the holes H which prevents the first cylindrical rod 24 from sliding out of the arm 22 and limits the movement of the guide 23 in the longitudinal direction. A second cylindrical rod 26 has one end fixedly secured to the arm 22. The second cylindrical rod 26 is parallel to the first cylindrical rod 24. The plate 28 is also fixedly secured to an end of the first cylindrical rod 24.

Figure 5:
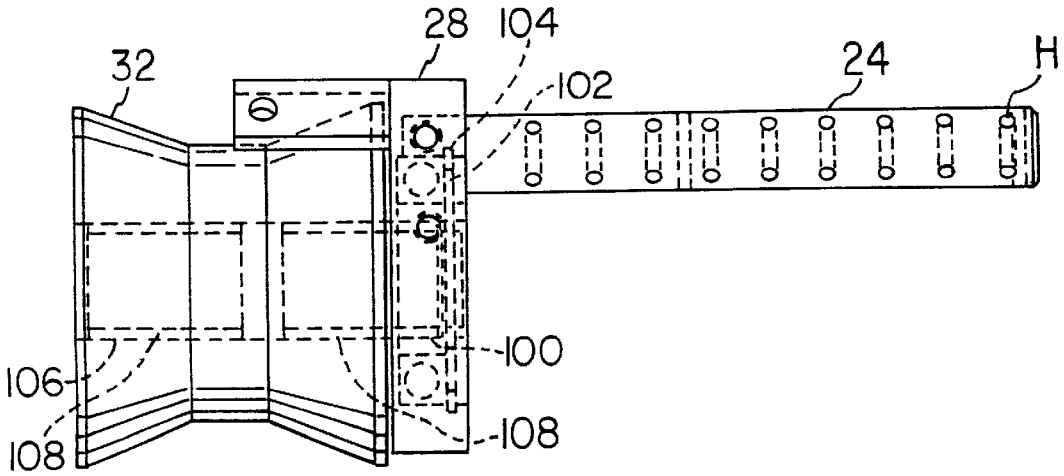
FIG. 5 is an elevation of a portion of the device shown in FIG. 2.

The plate 28 is rotatably attached to a roller 32 and the roller 32 is attached to the arm 22 through the second cylindrical rod 26. As shown in FIG. 5, the roller 32 includes a cylindrical extension 100. A ball bearing 102 is received by the plate 28 and sandwiched between the plate 28 and the extension 100 of the roller 32. A snap ring 104 holds the ball bearing 102 in place. A bore 106 passes through the roller 32. Two journal bearings 108 are received in the bore 106 and are held in place by snap rings. In this arrangement, the roller 32 is also rotatably secured to the second cylindrical rod 26.

Referring back to FIG. 2, the roller 32 includes a body B having two frusto-conical portions or flanges C and D and a central cylindrical portion E. The frusto-conical portions C and D and the central cylindrical portion E define a rail engaging surface 33 which has two tapered end surfaces formed by frusto-conical portions C and D converging toward a central cylindrical surface formed by portion E. A recess F is defined by the rail engaging surface 33. The journal bearings 108 define a hole through which the second cylindrical rod 26 passes. The journal bearings 108 permit the roller 32 to rotate and slide about a longitudinal axis X' passing through the second cylindrical rod 26. Longitudinal axes X and X' are parallel to each other. The second cylindrical rod 26 is attached to the arm 22. The ball bearing 102 is rotatably attached to the roller 32 and is attached to plate 28, and the roller 32 can move along the longitudinal axis X' and second cylindrical rod 26 relative to the arm 22. The roller 32 can rotate about the longitudinal axis X' relative to the arm 22, the plate 28 and the second cylindrical rod 26. In this arrangement, the roller 32 is slidably and rotatably attached to the arm 22 and moves along the X' axis or longitudinal axis relative to the arm 22.

A nozzle arrangement 34 is secured to the plate 28 through an adjustable bracket 35 that is attached to the nozzle arrangement 34. A bolt 36 secures the bracket 35 to the plate 28. The nozzle arrangement 34 includes a flow passageway P in fluid communication with a nozzle tip 37. The nozzle tip 37 is adapted to direct pressurized lubricant towards the rails at an angle $\alpha$, say, for example, at 45° from a vertical axis Y. As can be clearly seen in FIGS. 3 and 4, the nozzle tip 37 is positioned above the rails as opposed to below the top of the rails. This can prevent damage to the nozzle arrangement 34 and prevent derailments of the roller 32. Referring back to FIG. 2, a pressurized lubricant supply (not shown) is in fluid communication with the nozzle arrangement 34 through a hydraulic adaptor N connected to a flexible hose (not shown) in a manner well known in the art and will not be discussed in further detail. The position of the nozzle tip 37 can be adjusted to direct lubricant by loosening the bolt 36, adjusting the nozzle tip 37 and then retightening the bolt 36. In this arrangement, the position of the nozzle tip 37 is constant relative to roller 32. By constant, it is meant that the position of the nozzle tip 37 is a constant distance $\alpha$ spaced from the roller 32 irrespective of the rotation of the roller 32.

Operation of the device for lubricating a rail 10 will now be discussed referring to FIGS. 2–7. First, referring to FIG. 6, the device for lubricating a rail 10 is secured to a track vehicle, such as a pickup truck 40, through the arm 15 of the rail gear 12, which is mounted to the pickup truck 40 as shown in FIG. 4. Typically, the pickup truck 40 will include two rail gears 12, one adjacent the front tires of the pickup truck 40 and one adjacent the rear tires of the pickup truck 40. Typically, the rail gear 12 can be positioned in an engaged position, as shown, or a retracted position so that the flanged guide wheels 14 are not engaged with the rails 38. Each of the rail gears 12 includes two arms 15 and two flanged guide wheels 14 for engaging both rails 38 of a railroad track, of which only one rail 38 is shown. Preferably, two devices for lubricating a rail 10, of which only one is shown, are provided on a rear rail gear RG, one for lubricating each of the two spaced apart rails 38. Each of the spaced apart flanged guide wheels 14 is adapted to engage a surface 39 of the rails 38. As is evident, only one rail 38 is shown, but it is understood that two spaced apart rails 38 are provided.

Figure 1B:
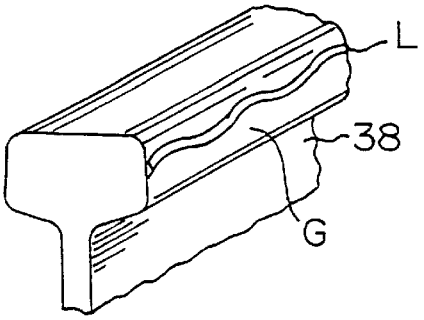
FIG. 1B PRIOR ART
FIG. 1B is a perspective view of a rail with a lubricant applied to a rail in a non-uniform manner.
Figure 1A:
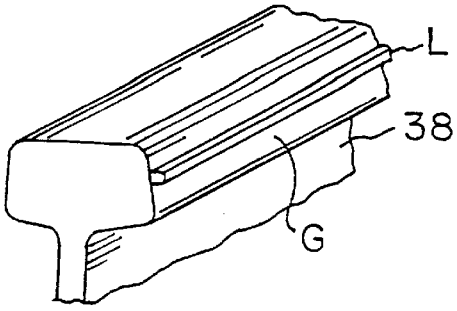
FIG. 1A is a perspective view of a rail with a lubricant applied to a rail in a uniform manner.
Figure 6:
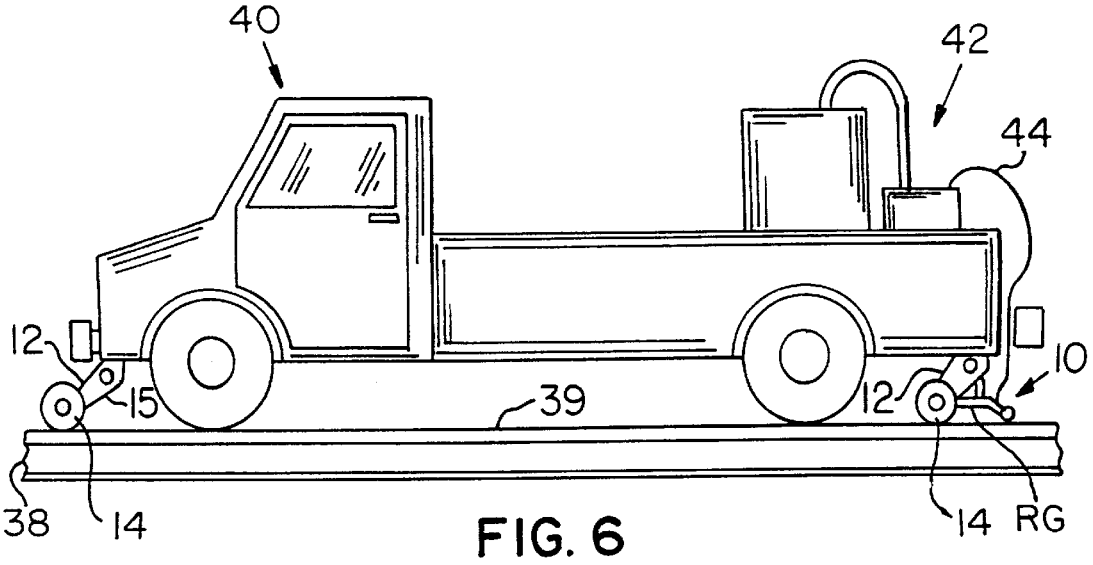
FIG. 6 is an elevation of the device shown in FIG. 2 attached to a pickup truck.

As the flanged guide wheels 14 engage the surfaces 39 of the rails 38, so do the rollers 32 as shown in FIGS. 2, 3 and 6. The rail extends along a longitudinal axis XR, which is different from longitudinal axes X and X'. As the pickup truck 40 moves along the rails 38, a pressurized lubricant supply 42, which is coupled to the nozzle arrangement 34 via a hose 44, is actuated so as to supply pressurized lubricant to the nozzle tip 37. The pressurized lubricant supply 42 is supported by the pickup truck 40. The directed lubricant leaves the nozzle tip 37 and is placed on the gauge surface G of the rail 38 as shown in FIG. 1A. As the pickup truck 40 moves along the rails 38, its position along the rails 38 relative to the longitudinal axis X may vary. Under prior art lubricating systems, this would cause the position of the lubricant L to vary on the rail 38 as shown in FIG. 1B. However, the present invention overcomes this deficiency by having the rail surface 39 received within the recess F and coacting with the tapered surfaces of the frusto-conical portions C and D of the roller 32 as shown in FIGS. 2 and 4. The tapered surfaces of the frusto-conical portions or flanges C and D are adapted to coact with the rail surface 39. As the pickup truck 40 moves along the rail 38, its position along the longitudinal axis X may vary, which causes the first cylindrical rod 24 to travel along the longitudinal axis X so that the roller 32 is always centrally positioned on the rail 38. The snap pin 30 limits the axial movement of the roller 32 along the longitudinal axes X and X'. Also, the roller 32 rests on the rail 38 because of the weight of the roller 32 and a moment applied to the arm 22 by the roller 32. In this arrangement, the roller 32 essentially "rides" on the rail 38 and is centrally positioned, even as the tapered surfaces wear over time.

Another problem of the prior art is that as the suspension of the pickup truck 40 changes or the weight carried by the pickup truck 40 changes with time, the prior art lubrication devices varied the position where lubricant was applied to the rails 38. The present invention overcomes this problem since the roller 32 directly rides on the rails 38 and the position of the nozzle tip 37 is dictated by the roller 32, not the truck body. The snap pin 30 limits the movement of the roller 32 in the longitudinal X direction and can be changed through holes H.

Figure 7:
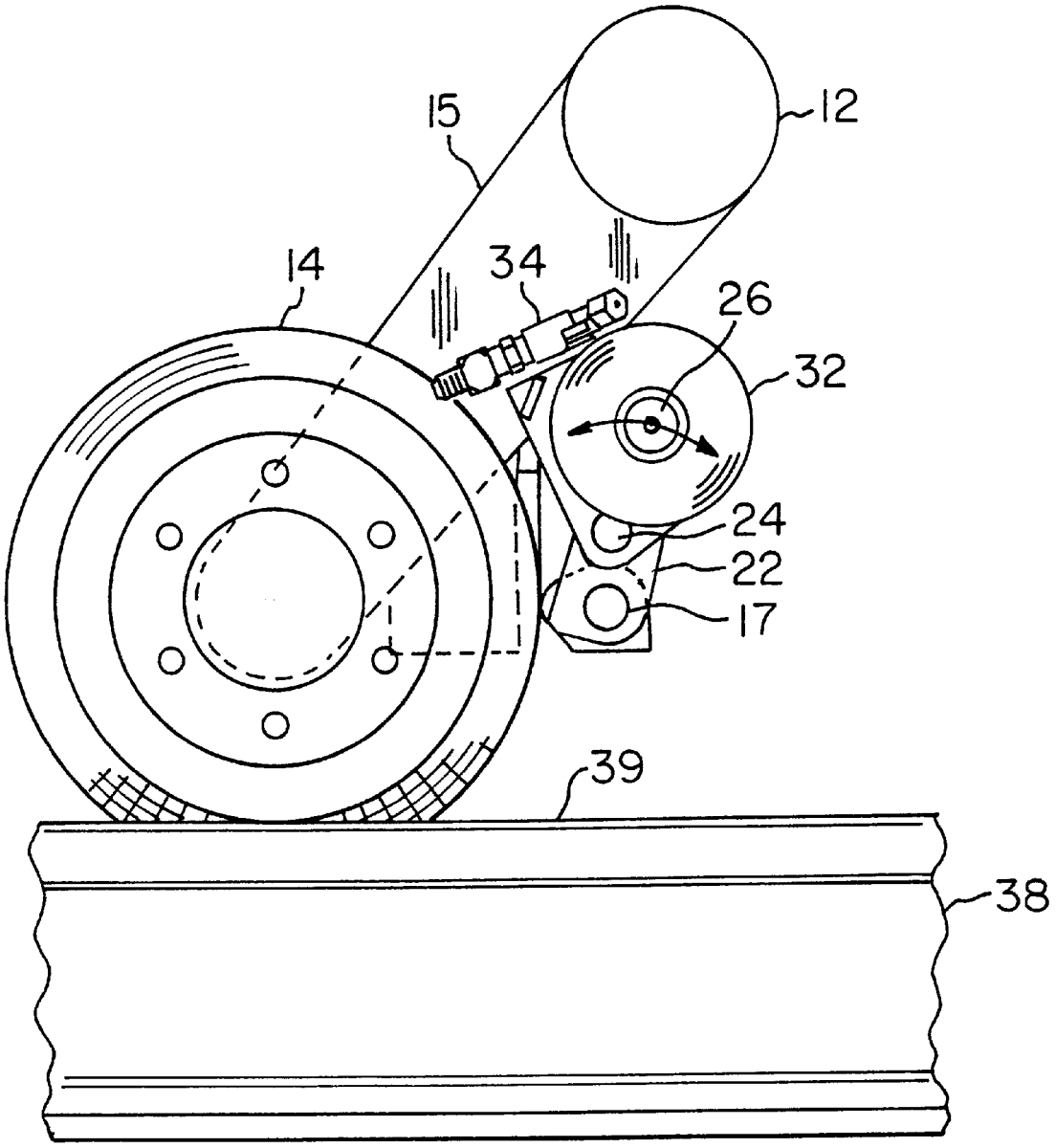
FIG. 7 is a side elevation of the device shown in FIG. 2 in an upper position.

In many cases, the pickup truck 40 will be used on the rails 38 that do not require lubricating. Of course, the flow of lubricant can be stopped from flowing through the nozzle tip 37 by disengaging the pumping system in a manner well known in the art. However, leaving the rollers 32 engaged with the rail surfaces 39 can cause unnecessary wear of the rollers 32. The present invention solves this problem by positioning the rollers 32 in an unengaged position as described below. Specifically, referring to FIG. 2, the snap pin 30 is removed from the first cylindrical rod 24 as the roller 32 is in the engaged position. The arm 22 is rotated about a longitudinal axis X" in a first direction $\omega$ and when the roller 32 disengages from the rail 38, the roller 32 is pulled away from the arm 22 causing the first cylindrical rod 24 to slide along the same direction until an end 46 of the first cylindrical rod 24 positioned furthest away from the roller 32 is contained within the arm 22. The arm 22 is rotated in the $\omega$ direction until the end 46 of the first cylindrical rod 24 is aligned with hole 21. Hole 21 extends along a longitudinal axis X'", where longitudinal axes X, X', X" and X'" are parallel to each other. The first cylindrical rod 24 is then pushed through hole 21 and passes through the frame member 16 and the snap pin 30 is removably positioned or received in one of the holes H positioned on an opposite side of the frame member 16 from the arm 22 thereby locking or maintaining the device for lubricating a rail 10 in a disengaged position as shown in FIG. 7. The hole 21 is adapted to receive the first cylindrical rod 24 for securing the arm 22 in the disengaged position. In the disengaged position, the roller 32 is not in contact with and positioned above the rail 38. The above method is reversed to engage the roller 32 with the rail 38.

Typically, an electric current passes through the rails 38. Therefore, as shown in FIG. 3, electrically insulated bushings or electric insulators 200 are provided in the frame member 16 between the shaft 17 pivotally connecting the arm 22 to the frame member 16. The bushings electrically insulate the arm 22, the cylindrical rods 24 and 26, the plate 28 and the roller 32 from the pickup truck 40 through the frame member 16. This will prevent electrically shorting the rails 38.

Figure 8:
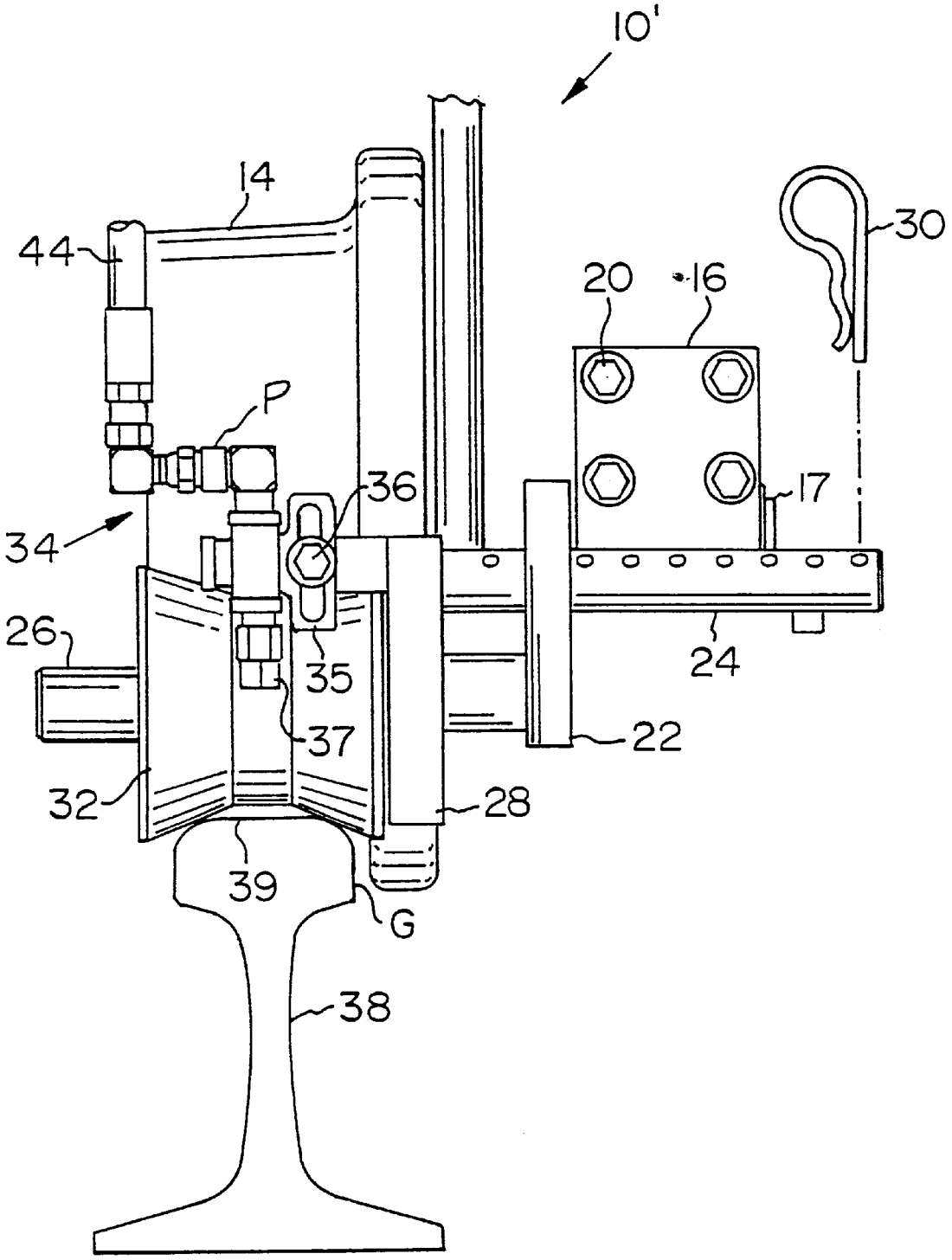
FIG. 8 is an elevation of a second embodiment of a device for lubricating a rail made in accordance with the present invention.

FIG. 8 shows another embodiment of a device for lubricating a top of a rail 10' made in accordance with the present invention, which is similar to the device for lubricating a rail 10 for lubricating a gauge surface G of a rail 38, with the exception that the nozzle arrangement 34 is secured to a tab 50, which is shown in FIG. 2. Therefore, only the differences will be discussed and like reference numerals will be used to describe like parts.

Specifically, the only difference between the device for lubricating a rail 10' and 10 is the position of the nozzle arrangement 34. The bolt 36 secures the bracket 35 to the plate 28 through the tab 50 so that the nozzle tip 37 is positioned directly over the top of the rail 38. In this manner, lubricant or a friction controller gel can be applied directly to the top of the rail 38 as opposed to the inner gauge surface G of the rail 38, as shown in FIG. 1A, which is accomplished by the device for lubricating a rail 10. It is also possible to have two nozzle arrangements 34 provided so that lubricant can be applied to the gauge surface G of the rail 38 and the top of the rail 38. With this arrangement, two different types of gels can be applied, one to the gauge surface G or side of the rail 38 and one to the top of the rail 38.

Having described the presently preferred embodiments of the present invention, it is to be understood that it may otherwise be embodied within the scope of the appended claims.

We claim:

1. A device for lubricating a rail extending along a first longitudinal axis, comprising:

a frame member adapted to be mounted to a track vehicle;

an arm pivotally attached to said frame member so that said arm pivots about a second longitudinal axis which is different from the first longitudinal axis;

a roller slidably and rotatably attached to said arm and adapted to ride on the rail, said roller adapted to rotate about a third axis which is parallel to the second longitudinal axis and slidably move along the third longitudinal axis relative to said arm; and a lubricating nozzle attached to said roller for directing a lubricant toward a rail, whereby said lubricating nozzle position is constant relative to said roller.

2. A device as claimed in claim 1, wherein said roller includes a tapered surface defining a recess adapted to receive a portion of a rail.

3. A device as claimed in claim 1, wherein said roller includes a flange adapted to coact with a rail.

4. A device as claimed in claim 1, wherein a guide is rotatably attached to said roller.

5. A device as claimed in claim 1, wherein said lubricating nozzle can be adjusted to direct lubricant in different directions.

6. A device as claimed in claim 1, further comprising a stop coupled to said arm for limiting movement of said roller along the third longitudinal axis.

7. A device for lubricating a rail, comprising:

a frame member adapted to be mounted to a track vehicle;

an arm pivotally attached to said frame member;

a roller slidably and rotatably attached to said arm and adapted to ride on a rail, said roller adapted to rotate and axially move relative to said arm;

a lubricating nozzle attached to said roller for directing a lubricant toward a rail, whereby said lubricating nozzle position is constant relative to said roller;

a guide rotably attached to said roller, said guide, comprising:

a first rod slidably extending through said arm; and a plate secured to an end of said first rod, said plate rotatably secured to said roller; and a second rod attached to said arm, said roller rotatably secured to said second rod, said second rod parallel to said first rod.

8. A device as claimed in claim 7, wherein said lubricating nozzle is attached to said plate.

9. A device as claimed in claim 7, wherein said frame member defines a hole adapted to receive said first rod for securing said arm in a disengaged position.

10. A device as claimed in claim 9, further comprising a stop removably received by said first rod for securing said arm in the disengaged position.

11. A device as claimed in claim 7, further comprising a stop attached to said first rod for limiting movement of said first rod in an axial direction and limiting movement of said roller.

12. A device as claimed in claim 11, wherein said stop comprises a pin adapted to be removably received by a hole defined in said first rod.

13. A device as claimed in claim 7, wherein said roller includes a tapered surface adapted to receive a portion of a rail.

14. A device as claimed in claim 7, wherein said roller is rotatably secured to said plate through a bearing and said roller is rotatably secured to said second rod through a bearing.

15. In combination, a track made up of at least one rail to be lubricated, said rail extending in a first longitudinal direction;

a wheeled vehicle for moving along said track; and a device for lubricating a rail, comprising:

a lubricant supply device supported by said wheeled vehicle lubricant supply;

a frame member mounted to said wheeled vehicle;

an arm pivotally attached to said frame member so that said arm pivots about a second longitudinal axis which is different from the first longitudinal axis;

a roller slidably and rotatably attached to said arm and adapted to ride on the rail, said roller adapted to rotate about a third axis which is parallel to the second longitudinal axis about and slidably move along the third longitudinal axis relative to said arm; and a lubricating nozzle attached to said roller for directing a lubricant toward said rail, whereby said lubricating nozzle position is constant relative to said roller.

16. In combination, a device for lubricating a rail extending along a first longitudinal axis; and a wheeled vehicle, said device for lubricating a rail extending along a first longitudinal axis, comprising:

a lubricant supply device supported by said wheeled vehicle;

a frame member mounted to said wheeled vehicle;

an arm pivotally attached to said frame member so that said arm pivots about a second longitudinal axis which is different from the first longitudinal axis;

a roller slidably and rotatably attached to said arm and adapted to ride on the rail, said roller adapted to rotate about a third axis which is parallel to the second longitudinal axis and slidably move along the third longitudinal axis relative to said arm; and a lubricating nozzle attached to said roller for directing a lubricant toward a rail, whereby said lubricating nozzle position is constant relative to said roller.

17. A device for lubricating a rail, comprising:

a frame member adapted to be mounted to a track vehicle;

an arm pivotally attached to said frame member;

a roller slidably and rotatably attached to said arm and adapted to ride on a rail, said roller adapted to rotate about and axially move relative to said arm;

a lubricating nozzle attached to said roller for directing a lubricant toward a rail, whereby said lubricating nozzle position is constant relative to said roller; and an electric insulator secured to said frame to electrically insulate said frame from said arm and said roller.

18. In combination, a device for lubricating a rail; and a wheeled vehicle, said device for lubricating a rail, comprising:

a lubricant supply device supported by said wheeled vehicle;

a frame member mounted to said wheeled vehicle;

an arm pivotally attached to said frame member;

a roller slidably and rotatably attached to said arm and adapted to ride on the rail, said roller adapted to rotate and axially move relative to said arm;

a lubricating nozzle attached to said roller for directing a lubricant toward a rail, whereby said lubricating nozzle position is constant relative to said roller; and a second arm mounted to said wheeled vehicle and a wheel adapted to engage with a rail rotatably mounted to said second arm, said frame member mounted to said second arm.

19. In combination, a track made up of at least one rail to be lubricated;

a wheeled vehicle for moving along said track; and a device for lubricating a rail, said device for lubricating a rail comprising:

a lubricant supply device supported by said wheeled vehicle;

a frame member mounted to said wheeled vehicle;

an arm pivotally attached to said frame member;

roller slidably and rotatably attached to said arm and adapted to ride on a rail, said roller adapted to rotate and axially move relative to said arm;

a lubricating nozzle attached to said roller for directing a lubricant toward said rail, whereby said lubricating nozzle position is constant relative to said roller; and a second arm mounted to said wheeled vehicle and a wheel engaged with said rail rotatably mounted to said second arm, said frame member mounted to said second arm.

* * * * *